US005454598A

United States Patent [19]

Wicker

[11] Patent Number: 5,454,598

[45] Date of Patent: Oct. 3, 1995

[54] TAMPER AND COPY PROTECTED DOCUMENTS

[76] Inventor: David M. Wicker, 4523 Red School Rd., Dansville, N.Y. 14437

[21] Appl. No.: 47,402

[22] Filed: Apr. 19, 1993

[51] Int. Cl.[6] ..... B42D 15/00

[52] U.S. Cl. ..... 283/67; 283/105

[58] Field of Search ..... 283/67, 70, 72, 283/93, 95, 105–107, 109, 110, 57–59, 901, 902; 281/2, 5

[56] References Cited

U.S. PATENT DOCUMENTS 4,163,570 8/1979 Greenaway ..... 283/95 X 4,629,630 12/1986 Devrient ..... 283/95 X 5,137,304 8/1992 Silverschotz et al. ..... 283/58 X

*Primary Examiner*—Willmon Fridie

*Attorney, Agent, or Firm*—Robert J. Bird

[57] ABSTRACT

A tamper and copy protected document includesn array of fine blind holes (or, alternatively, of fine perforations) impressed on the document in areas where specific information is to be imprinted. Imprinting of information on the array of holes (or perforations) results in penetration of ink into the fibrous interior of the document, between its surfaces. A resinous coating, applied over the array and over the imprinted information, also penetrates into the interior to encapsulate the ink. A copy protected document is produced by imprinting it with specific alphanumeric information which includes perforations in the imprinted characters.

8 Claims, 2 Drawing Sheets

TAMPER AND COPY PROTECTED DOCUMENTS

FIELD OF THE INVENTION

This invention relates to tamper and copy protected documents, and to methods for imprinting documents with tamper proof information.

BACKGROUND INFORMATION

Documents have been subjected to tampering for various fraudulent purposes. Checks, other negotiable instruments, licenses, and forms of identification are examples. The ordinary check is a printed blank form on which specific information is added by the user, including the name of the payee and the monetary amount. This added specific information is typically the least permanent information on the paper. Tamperers have been able to lift, scrape, or otherwise remove and alter it.

The prior art includes mechanical check writing devices which emboss the monetary amount on a blank check, and which perforate the previously written name of the payee. The perforations made by these devices were of such size and so ragged that they probably could not be used today, when checks are largely processed and handled by automated equipment.

It is an object of this invention to provide a method and means for imprinting tamper proof specific information on a document.

SUMMARY OF THE INVENTION

The present invention is a tamper and copy protected document, and methods for imprinting documents with tamper proof information. An array of fine blind holes (or, alternatively, of fine perforations) is impressed on the document in areas where specific information is to be imprinted. Imprinting of information on the array of holes (or perforations) results in penetration of ink into the fibrous interior of the document, between its surfaces. A resinous coating, applied over the array and over the imprinted information, also penetrates into the interior to encapsulate the ink. A copy protected document is produced by imprinting it with specific alphanumeric information which includes perforations in the imprinted characters.

DRAWING

DESCRIPTION

Figure 1:
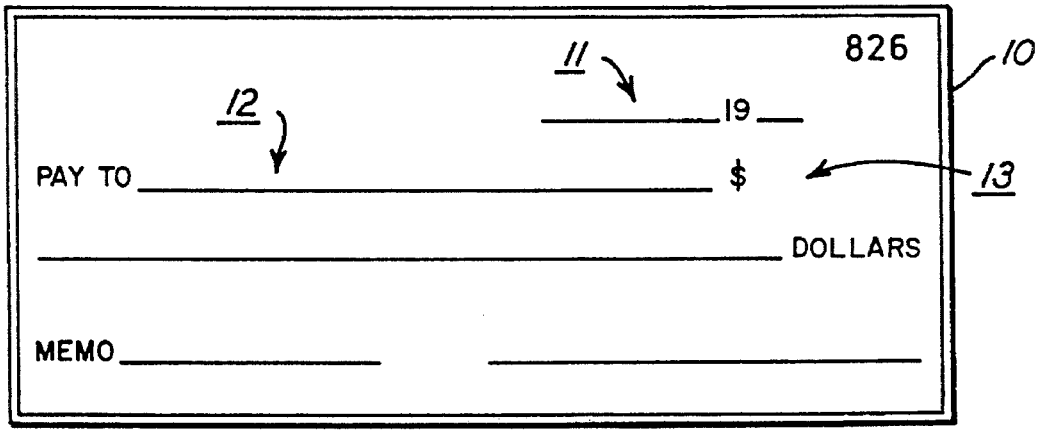
FIG. 1 shows a typical check of the prior art.

FIG. 1 shows a check 10 with areas for writing or imprinting specific information, including the date 11, payee 12, and monetary amount 13. The typical check 10 is a paper or card with a hard smooth surface. It is subject to tampering because, whether printed or hand written, the ink is applied on the hard smooth surface and little or none of it is absorbed into the fibrous interior. It is possible to scrape or otherwise remove the ink with little or no apparent damage to the paper.

Figure 2:
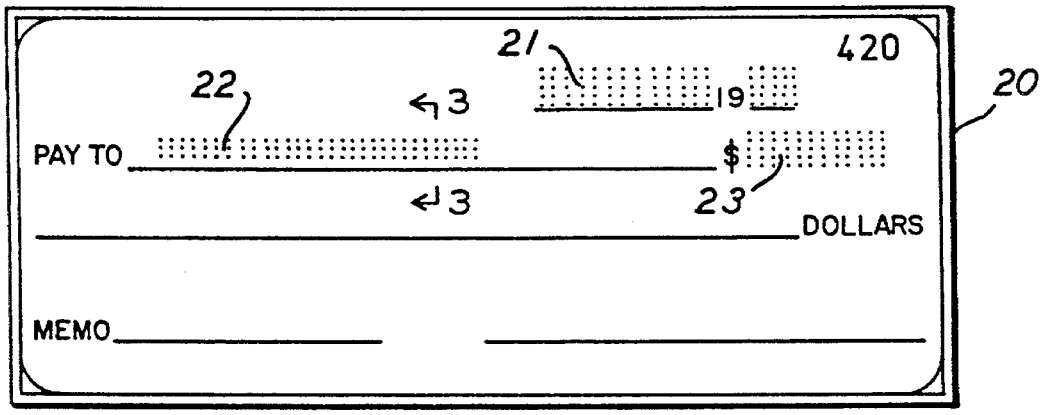
FIG. 2 shows a check according to one form of this invention.
Figure 3:
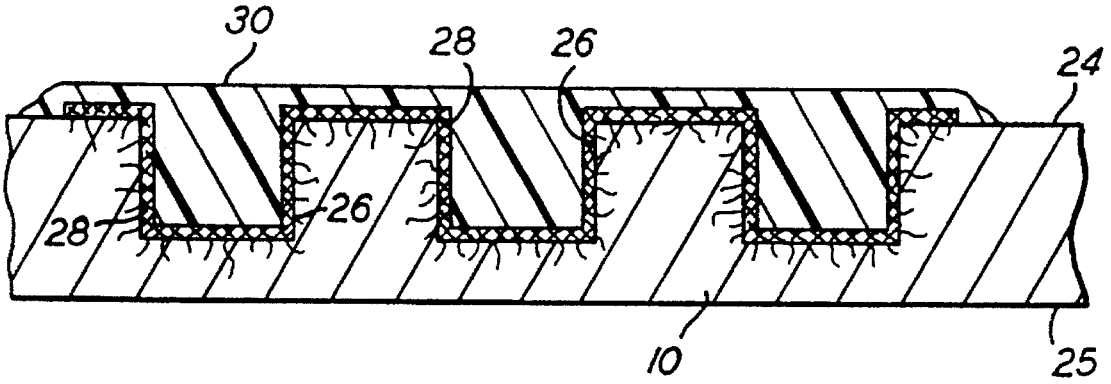
FIG. 3 is a greatly enlarged sectional view on the line 3—3 of FIG. 2.

FIG. 2 shows a check 20 according to one form of this invention, with areas for the issuer to write or print the date 21, payee 22, and amount 23. FIG. 3 is an enlarged sectional view of the amount area 23 of the check 20. The check 20 is a paper or card with hard and smooth top and bottom surfaces 24, 25. The areas 21, 22, 23 of the top surface 24 include arrays of small holes 26 which break the skin or top surface 24 of the check. These holes 26 may be round, square, oblong, triangular, or other shape. In any case, they are small holes of uniform size. I prefer holes approximately 0.003" across, but they can be as large as 0.011" across. The holes 26 are in rows of 70–80 holes per linear inch, and 33 rows per inch of width. The holes 26 are blind holes, i.e. they break the top skin or surface 24 of the paper, extend only part way through the paper, and do not penetrate the bottom surface 25.

With the surface 24 broken by the holes 26 in the areas 21, 22, 23, some of the ink 28 applied on those areas to add specific information to the check, goes into the holes and into the fibrous body of the paper beneath the surface 24. Absorption and capillary action in the internal fibers carries the ink, to a small extent, into areas adjacent the immediate line of impact. The capillary and absorption actions at this microscopic level enhance the adherence of ink to paper, making it virtually impossible to remove the ink by any mechanical means without damaging the paper.

Figure 4:
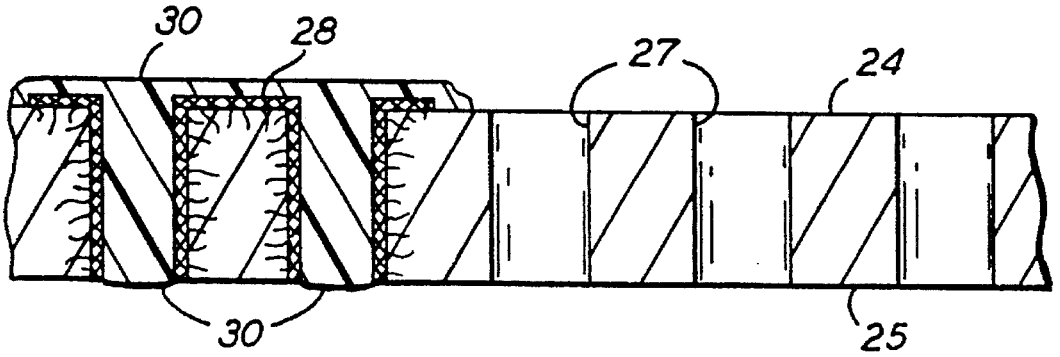
FIG. 4 shows a modified form of the arrangement of FIG. 3.

The modification of FIG. 4 includes arrays of perforations 27 (instead of blind holes 26) through both top and bottom surfaces 24, 25. The effect of the perforations 27 is even more pronounced than that of the blind holes 26 in FIG. 3. The increased surface area exposed by the perforations 27, as compared with the blind holes 26, increases the amount of ink absorbed and carried into the fibrous body of the paper.

Figure 5:
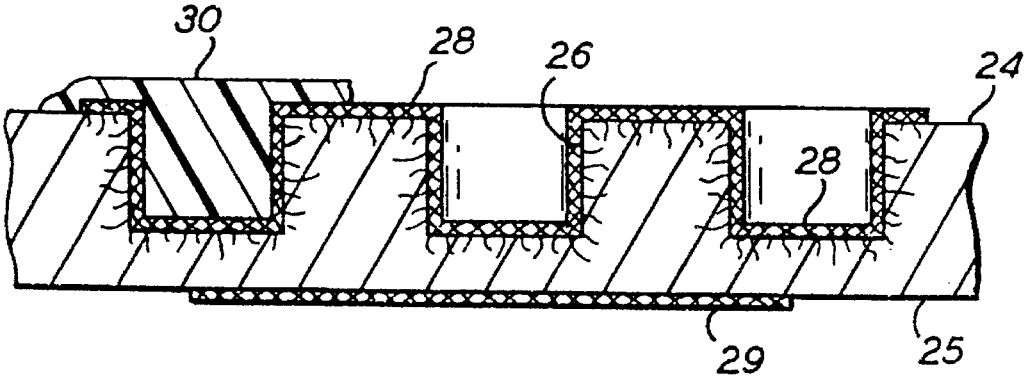
FIG. 5 shows another modified form of the arrangement of FIG. 3.

In the modification of FIG. 5, the bottom surface 25 of the check 20 includes a number of inked areas 29 in registry with the arrays of holes in the areas 21, 22, 23 on the top surface 24. The bottom layer of ink 29 provides further protection, because any attempt to scrape ink from the top surface 24 and from within the holes 26, will only encounter further difficulty in the bottom ink layer 29.

The holes 26, 27 are too small to be clearly shown in FIG. 2, and so they are represented there by dots in the shaded areas 21, 22, 23. These shaded areas represent arrays of these holes.

Checks are handled and processed in the banking system largely by automated processing equipment. It is important that the checks not have tears, staples, or other interfering protrusions. Therefore, the holes 26 and 27 are so formed as to be free of burrs or ragged edges.

After the ink is applied, a clear plastic or resinous coating 30 is applied over it. The resin is preferably a water based acrylic resin and is sufficiently fluid that it too seeps into the holes and into the paper fibers to seal and encapsulate the ink, on and in the paper. The resinous coating is an option, and may or may not be necessary or desired, depending on economics or other considerations.

As described above, the holes were applied to the check before the specific information was printed on it. The technique works just as well if the holes are applied after the information is printed.

To this point the emphasis has been on printing documents for protection against tampering. Another purpose of this invention is to authenticate or validate a document and protect is against copying.

Color copying has so developed that credible reproductions, or at least superficially credible reproductions, of documents such as traveler's checks, drivers' licenses, identification cards, food stamps, and the like can now be made by available copying equipment. But photocopiers can reproduce only appearance. They do not replicate physical condition, e.g. a tear or hole in the original.

Figure 6:
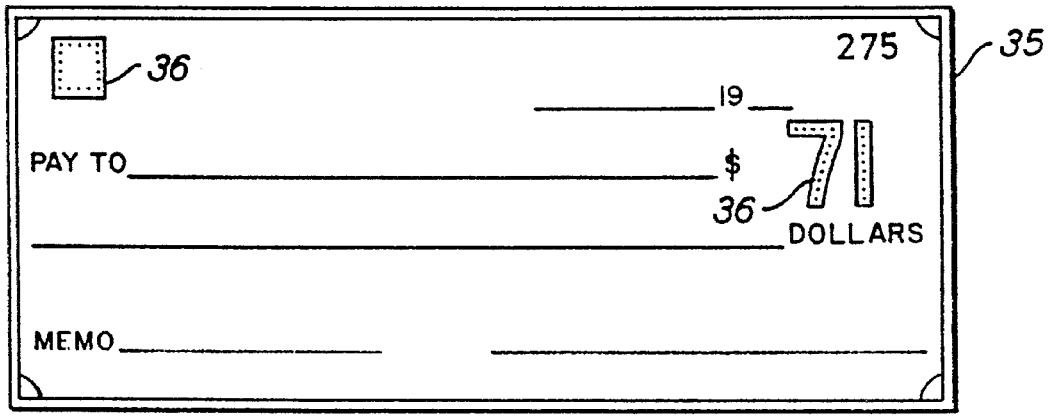
FIG. 6 shows a document validated by perforations according to this invention.

FIG. 6 shows a document 35 validated by an array of perforations 36, of size and density similar to those in the check 20. First, the perforations 36 are practically invisible to the casual observer. The document 35 will generally have to be held up to bright light or daylight for them to be seen. Second, the perforations do not reproduce in a copier. Third, if a counterfeit copy is attempted on a copier, it is easily detected because it will not have the perforations. A knowledgeable teller or clerk can readily identify a false copy. As an aid to the verification process, and to the verifier, it is preferred that the array of perforations be located at some readily found location, such as on an eagle or other prominent feature of the printed document, represented at the upper left of FIG. 6. This technique is applicable to documents in general. In the case of a check, as in FIG. 6, the specific information, such as the numerals 71 can itself be directly imprinted with perforations 36 included within it.

My invention is described here for convenience in the context of checks printed on paper. These techniques are applicable, however, to any kind of document, and to substrates or support media other than paper. In the claims, the term "imprinted information" is meant to include all information added to a document, by manual or mechanical means, handwritten, printed, typed, and so on.

The foregoing description of preferred embodiments of this invention, including any dimensions, angles, or proportions, is intended as illustrative. The concept and scope of the invention are limited only by the following claims and equivalents thereof.

What is claimed is:

1. A document sheet with top and bottom surfaces;

said top surface including an information area for application thereon of specific inked information; and an array of fine blind holes penetrating said top surface but not said bottom surface in said information area to facilitate penetration and absorption of ink in the interior of said sheet between said surfaces.

2. A document sheet as defined in claim 1, further including:

a clear aqueous acrylic resinous coating applied over said array and over said specific information thereon, said coating penetrating said holes and the interior of said sheet between said surfaces to encapsulate said ink.

3. A document sheet as defined in claim 1, further including:

a solid dark area on said bottom surface under said information area.

4. A document sheet with top and bottom surfaces;

said top surface including an information area for application thereon of specific inked information;

an array of fine holes through said top surface in said information area to facilitate penetration and absorption of ink in the interior of said sheet between said surfaces; and a clear aqueous acrylic resinous coating applied over said array and over said specific information thereon, said coating penetrating said holes and the interior of said sheet between said surfaces to encapsulate said ink.

5. A method of producing a tamper protected document, including the following steps, taken in either sequence:

(a) applying to a document sheet having top and bottom surfaces an array of fine blind holes penetrating said top surface but not said bottom surface, forming an information area to receive specific inked information; and (b) imprinting specific information on said information area, said holes enhancing the penetration of ink into the interior of said sheet between said surfaces.

6. A method as defined in claim 5, further including, after step (a), the additional step:

(aa) extending said holes through said bottom surface.

7. A method of producing a tamper protected document, including the following steps, of which steps (a) and (b) may be taken in either sequence:

(a) applying to a document sheet having top and bottom surfaces an array of fine holes through said top surface, forming an information area to receive specific inked information;

(b) imprinting specific information on said information area, said holes enhancing the penetration of ink into the interior of said sheet between said surfaces; and (c) applying a resinous coating over said array and over said specific information thereon to penetrate said holes and the interior of said sheet between said surfaces to encapsulate said ink.

8. A method as defined in claim 7, further including, after step (a), the additional step:

(aa) extending said holes through said bottom surface.

* * * * *